United States Patent [19]

Schmid

[11] 4,152,009

[45] May 1, 1979

[54] SKI AND SAFETY BINDING FOR THE SAME

[76] Inventor: Manfred Schmid, Hausener Str. 27, D-8011 Kirchheim, Fed. Rep. of Germany

[21] Appl. No.: 871,956

[22] Filed: Jan. 24, 1978

[30] Foreign Application Priority Data

Jan. 25, 1977 [DE] Fed. Rep. of Germany ..... 2702963

[51] Int. Cl.[2] ..... A63C 9/08

[52] U.S. Cl. ..... 280/614; 280/618

[58] Field of Search ..... 280/614, 618

[56] References Cited

U.S. PATENT DOCUMENTS 2,400,065 5/1946 Beerli ..... 280/614

FOREIGN PATENT DOCUMENTS 2307427 12/1973 Fed. Rep. of Germany ..... 280/614

2329880 1/1975 Fed. Rep. of Germany ..... 280/614

2418577 10/1975 Fed. Rep. of Germany.

*Primary Examiner*—Joseph F. Peters, Jr.

*Assistant Examiner*—Milton L. Smith

*Attorney, Agent, or Firm*—Hans Berman

[57] ABSTRACT

A ski is equipped with a binding alternatively suitable for cross country skiing and downhill skiing. A base plate is normally secured to the top face of the ski runner and a detent projects rearward from the plate. The front end of a boot carrier is pivoted to the corresponding end of the base plate so that its rear end can swing toward and away from a downhill skiing position near the base plate. A latch engages two transversely spaced, longitudinal guides on the carrier for movement toward and away from a position of engagement with the detent in which the engaged latch and detent prevent the carrier from swinging upward from the downhill skiing position as is necessary in cross country skiing.

9 Claims, 3 Drawing Figures

A
III
III

SKI AND SAFETY BINDING FOR THE SAME

This invention relates to skis, and particularly to a safety binding that may be used alternatively for cross country skiing and downhill skiing, and to a ski whose runner is equipped with such a binding.

For cross country skiing, the binding should permit the heel of the skier to move freely toward and away from the top surface of the runner to which only the toe portion of his boot is fastened. For adequate ski control during downhill or alpine skiing, the entire sole of the skier should rest on the runner. Additionally, the binding should release the boot and foot of the skier from the ski in the event of a spill to prevent leg fractures and other injuries.

It is known from the published German patent application No. 24 18 577 to mount a base plate on the top surface of the ski runner in such a manner that it will be released automatically from the runner under stresses which may be generated in a spill. The toe end of a boot carrier is pivoted to the front end of the base plate so that the heel of a boot attached to the carrier may be moved up and down as required in cross country skiing. The carrier may be locked to the base plate as required for downhill skiing. The locking device, however, is arranged in such a manner that it cannot be released when the skier's boot is in its normal position.

It is a primary object of this invention to provide a binding of the type described which may be adjusted between its cross country and downhill skiing conditions without releasing the boot from the binding, a procedure which, even when simple, involves the risk of the released ski escaping downhill and out of the skier's reach.

With this object and others in view, as will presently become apparent, the invention provides a convertible ski binding in which a base assembly, normally attached to the runner, includes an elongated base plate and a detent, the detent projecting rearward from the longitudinally terminal rear portion of the base plate. A carrier has longitudinally terminal toe and heel portions and includes two transversely spaced, longitudinal guide portions which connect the toe and heel portions. A pivot connects the toe portion of the carrier to the longitudinally terminal front portion of the base plate so that the heel portion of the carrier can move about a pivot axis transverse to the base plate and carrier toward and away from a downhill skiing position angularly closely juxtaposed to the rear portion of the base plate. A latch engages the two guide portions of the carrier for longitudinal sliding movement on the carrier toward and away from a position of engagement with the detent in which the engaged latch and detent prevent angular movement of the heel portion of the carrier away from its downhill skiing position. A piece of the skier's footwear may be secured to the carrier.

Other features, additional objects, and many of the attendant advantages of this invention will readily be appreciated as the same becomes better understood from the following detailed description of a preferred embodiment when considered in connection with the appended drawing in which.

Figures 1, 2, 3:
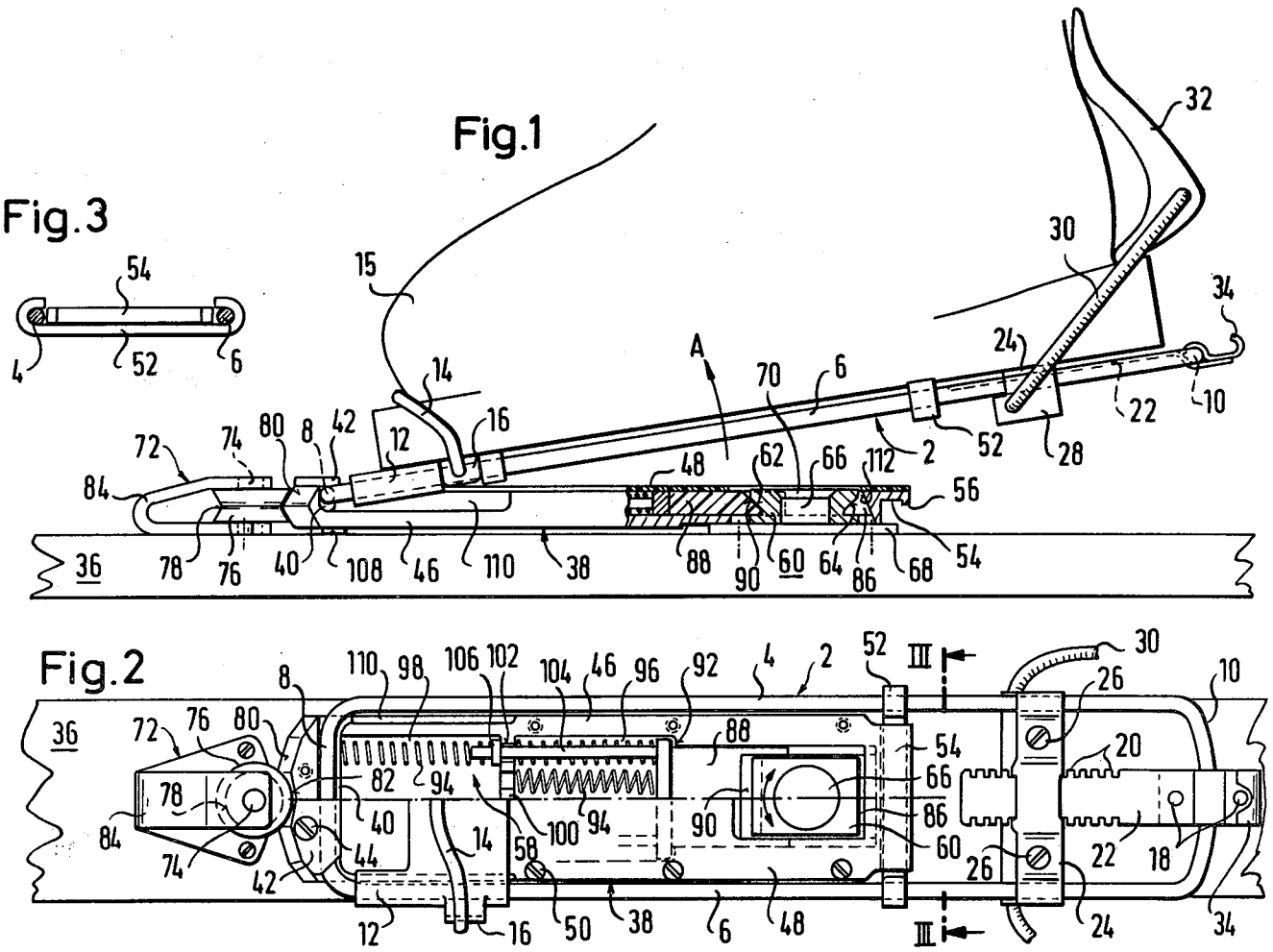
FIG. 1 shows a binding of the invention and portions of an attached ski runner and boot in side elevational, partly sectional view, the binding being in condition for cross country skiing.
FIG. 2 is a top plan view of the binding and ski runner portion of FIG. 1 in the downhill skiing condition, portions of the binding being broken away to reveal internal structure.
FIG. 3 illustrates elements of the binding of FIG. 2 in rear elevational section on the line III—III.

Referring now to the drawing in detail, there is shown a boot carrier 2 which is a unitary metal rod bent into the approximate shape of a long rectangle, the two long, longitudinal portions 4,6 of the carrier 2 being connected by short, transverse sections 8,10 which constitute the longitudinally terminal portions of the carrier 2. A supporting plate 12 is placed atop the front ends of the carrier portions 4,6 and is secured by its lateral edges being wrapped about the carrier portions with clamping pressure. Integral, lateral, apertured lugs 16 laterally project beyond the carrier 2 and provide bearings for a loop 14 of strong wire which holds the toe end of a boot 15 to the plate 12.

A flat metal bar 22 is attached to the center of the transverse rear carrier section 10 by two screws 18 and a nonillustrated clamp. It extends forward from the section 10, and its two longitudinal edges are provided with notches 20. A transverse strap 24 is wrapped over the carrier portions 4,6 with sufficient clearance to permit longitudinal sliding movement of the strap when bolts 26 are loosened to permit the strap and a heavy bar 28 to be moved apart sufficiently for release of projections on the strap 24 from notches 20. A plastic coated steel cable 30 is attached to the two ends of the bar 28 and carries a toggle 32 which retains the heel of the boot 15. A hook 34 rearwardly projecting from the carrier section 10 may engage a flexible strap fastened to the ski runner 36, not shown, but conventional, to limit upward movement of the section 10 and of the associated boot heel from the ski runner 36.

The transverse front section 8 of the carrier is pivotally fastened to the front end of a base assembly 38. It includes a heavy, elongated plate 46 formed with a transverse groove 40 in which the carrier section 8 is pivotally received. Accidental escape of the carrier section is prevented by a metal cover 42 attached to the plate 46 by screws 44. The cover 42 also retains a sheet 48 of ice-repelling plastic which covers the plate 46 to its rear end and is additionally fastened by rows of screws 50. The lugs 16 may enter recesses 110 in the plate 46 in the downhill skiing position of the carrier 2.

The two ends of a strap 52 of sheet material are bent into arcs of 180°, best seen in FIG. 3, and looped over the longitudinal carrier portions 4,6 with sufficient clearance to permit longitudinal movement of the strap 52 to be guided, but not impeded by the portions 4,6. The main portion of the strap 52 is located below the carrier 2, and the movements of the strap, therefore, are not interfered with by the boot 15. An integral detent 54 projects rearwardly from the base plate 46, and its free end portion 56 is offset downward. When the carrier is swung from the position of FIG. 1 toward the ski runner 36 against the direction of an arrow A, the main portion of the strap 52 clears the detent portion 56 and may be pushed forward manually on the carrier 2 until it is received as a latch in the recess partly bounded by the detent portion 56 and holds the carrier 2 in the downhill skiing position as is shown in FIG. 2.

If the strap 24 is properly adjusted on the bar 22, the boot 15 is unlikely to be released unintentionally from the carrier 2, the cable 30 being tensioned by the toggle 32 until released manually. However, the boot 15 and carrier 2 may be released from the runner 36 together with the base assembly 38 in the event of a bad spill or other accident before the leverage of the ski runner can cause injury to the skier, the base assembly being secured to the runner 36 only by a spring arrangement 58 carefully chosen according to the weight of the skier, the length of the runner 36, the skier's skill and other variables affecting the binding stress at which the ski should be released from the boot 15.

A mounting block 60 is received in an aperture 86 of the base plate 46. It is generally of rectangular, prismatic shape except for beveled front and rear faces 62,64 which slope obliquely downward toward a generally cylindrical pin 66 rotatably received in a conforming opening of the block 60. The pin 66 has an integral flat base 68 fixedly attached to the top face of the ski runner 36, and its free end 70 flares conically so as to secure the block 60 against axial movement relative to the pin 60. The turning axis of the mounting block 60 and of the base assembly 38 on the ski runner 36 is aligned approximately with the center of the boot 15.

Longitudinal stresses between the runner 36 and the base assembly 38 are mainly absorbed by an abutment arrangement 72. One leg of an approximately U-shaped bracket 84 is fixedly bolted to the top face of the runner 36. A shaft 74, approximately parallel to the turning axis of the block 60 carries a wheel 76 whose circumference is provided with a V-shaped groove 78. The short front edge 80 of the base plate 46 is V-shaped in cross section to match the groove 78 in which it is received. The edge 80 is arcuate about a center near the block 60, but its center is provided with a shallow notch 82.

The afore-mentioned spring arrangement 58 includes several helical compression springs 94 of which only three are seen in FIG. 2. The springs 94 are mounted in two recesses 96,98 of the base plate 46 to which access can be had only by removing the plastic sheet 48, and which are separated by an aperturned transverse partition 100. The springs 94 in the rear recess 96 are interposed between the fixed partition 100 and a slide 88 which is biased rearward by the springs into abutting engagement with a shoulder 92 of the plate 46 in the recess 96. The beveled rear face 90 of the slide 88 normally engages the beveled face 62 of the mounting block and prevents turning of the block on the pin 66 under applied twisting forces insufficient to overcome the springs 94.

The springs in the rear recess 96 are each coiled about a rod 104 which passes through an aperture 102 in the partition 100 and carries a spring seat 106 in the front recess 98. A spring 94 is compressed between each seat 106 and the front wall of the recess 98, only one rod 104, spring seat 106, and the associated spring 94 in the recess 98 being shown in order not to crowd the drawing. The several springs 94 thus keep the wheel 76 in the shallow notch 82 of the front edge 80.

The clearance between the walls of the aperture 86 in the plate 46 and the mounting block 60 is sufficient to permit escape of the base plate 46 from the block 60 if the slide 88 is pushed forward by a twisting motion of the binding after release of the wheel 76 from the notch 82 or by other forces. The rear wall of the plate 46 in the aperture 86 slopes obliquely downward and rearward to facilitate release of the mounting block 60.

It is essential for proper functioning of this escape mechanism that the number and stiffness of the springs 94 be chosen carefully by an experienced fitter to match the characteristics of the skier outlined above. Springs too numerous or too strong may cause injury to the skier. Overly weak springs may result in unnecessary release of a binding and loss of a ski runner. The need for a simple tool, such as a screwdriver, for access to the springs 94 provides a usually effective deterrent to ill-advised tampering with the spring tension by the unskilled.

The plastic sheet 48 prevents the formation of an ice layer which may otherwise freeze the carrier 2 to the base assembly 38 in the downhill skiing position. The bar 28 which rests on the top surface of the runner 36 in the downhill skiing position is preferably coated with polytetrafluoroethylene or similar ice repelling plastic for the same reason, and a strip 108 of the same material on the underside of the base plate 46 near the front edge 80 prevents a strong ice bridge from connecting the base assembly 38 to the runner 36. The groove 78 in the wheel 76 is far enough above the top face of the runner 36 to keep the front end of the bottom plate 46 out of direct contact with the runner, the rear end of the bottom plate resting on the base 68 of the pin 66. If the strap 52 should freeze to the carrier portions 4,6, it can be released by manually bending the two, somewhat resilient portions transversely toward each other.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A ski binding alternatively suitable for cross country skiing and downhill skiing comprising:

(a) an elongated base assembly including an elongated base plate member and a detent,
  (1) said base plate member having first and second longitudinally terminal portions,
  (2) said detent projecting from said second portion in a direction away from said first portion;

(b) an elongated carrier member having first and second longitudinally terminal portions and including two transversely spaced longitudinal guide portions connecting said terminal portions of said carrier member;

(c) pivot means connecting said first portions of said members for movement of said second portions about a pivot axis transverse to the respective directions of elongation of said members toward and away from a downhill skiing position in which said second portions are angularly closely juxtaposed relative to said pivot axis;

(d) a latch member engaging said guide portions for longitudinal sliding movement on said carrier member toward and away from a position of engagement with said detent in which the engaged latch member and detent prevent angular movement of said second portions away from said downhill skiing position;

(e) first securing means for securing said base plate assembly on a ski; and (f) second securing means for securing a piece of footwear to said carrier member.

2. A binding as set forth in claim 1, wherein said carrier member has a first face directed toward said base plate member and a second face directed away from said base assembly, said second securing means include means for securing said piece of footwear to said second face, said latch member extending from said first face toward said base plate member and being free of a piece of footwear secured to said second face, whereby said latch member may be moved toward and away from said position thereof without releasing said piece of footwear from said carrier member.

3. A binding as set forth in claim 1, wherein said first securing means include a mounting member engaging said base plate member for relative angular movement about a turning axis transverse to the direction of elongation of said base plate member and transverse to said pivot axis, abutment means, fastening means for fastening said mounting member and said abutment means on a ski, said base assembly including yieldably resilient means for releasably holding said portions of said base plate member engaged with said abutment means and said mounting member respectively.

4. A binding as set forth in claim 3, wherein said base plate member is formed with an opening therein receiving said mounting member, said yieldably resilient means including a slide longitudinally movable on said base plate member and a spring backing said slide, said slide and said mounting member having matingly engageable engagement faces.

5. A binding as set forth in claim 4, further comprising an abutment on said base plate member limiting movement of said slide toward said mounting member.

6. A binding as set forth in claim 4, wherein said base plate member is formed with a recess, said spring being mounted in said recess, said base assembly including cover means preventing access to said spring without the use of a tool.

7. A binding as set forth in claim 3, wherein said abutment means include a wheel formed with a circumferential groove therein, said fastening means including a bracket member, said wheel being mounted on said bracket member for rotation about an axis approximately parallel to said turning axis, said first portion of said base plate member being received in said groove under the pressure of said yieldably resilient means.

8. A ski comprising, (a) an elongated runner having a longutidinal bottom face adapted for sliding engagement with a snow surface and a longutidinal top face; and (b) a binding as set forth in claim 7, said first securing means securing said base plate assembly to said top face, said wheel being mounted on said bracket far enough from said top face to keep said bottom plate member out of direct contact with said top face.

9. A binding as set forth in claim 1, wherein said second securing means include means for fixedly securing said piece of footwear against longitudinal movement relative to said carrier member during said sliding movement of said latch member.

* * * * *